US010267243B2

(12) United States Patent
McQuillen et al.

(10) Patent No.: US 10,267,243 B2
(45) Date of Patent: Apr. 23, 2019

(54) METHOD AND SYSTEM FOR PULSED ENGINE WATER INJECTION

(71) Applicant: Ford Global Technologies, LLC, Dearborn, MI (US)

(72) Inventors: Michael McQuillen, Warren, MI (US); Daniel A. Makled, Dearborn, MI (US); Mohannad Hakeem, Dearborn, MI (US); Gopichandra Surnilla, West Bloomfield, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 130 days.

(21) Appl. No.: 15/384,172

(22) Filed: Dec. 19, 2016

(65) Prior Publication Data

US 2018/0171891 A1 Jun. 21, 2018

(51) Int. Cl.

| | |
|---|---|
| ***F02D 19/12*** | (2006.01) |
| ***F02D 41/14*** | (2006.01) |
| ***F02M 25/028*** | (2006.01) |
| ***F02D 35/02*** | (2006.01) |
| ***F02M 25/022*** | (2006.01) |

(Continued)

(52) U.S. Cl.

CPC ..... *F02D 19/12* (2013.01); *F02D 35/027* (2013.01); *F02D 41/009* (2013.01); *F02D 41/0025* (2013.01); *F02D 41/0085* (2013.01); *F02D 41/144* (2013.01); *F02D 41/1456* (2013.01); *F02D 41/2451* (2013.01); *F02D 41/2467* (2013.01); *F02M 25/028* (2013.01); *F02M 25/0227* (2013.01); *F02M 35/104* (2013.01); *F02M 35/10393* (2013.01)

(58) Field of Classification Search

CPC ..... F02D 19/12; F02D 41/26; F02D 41/2438; F02D 35/027; F02M 35/104; F02M 35/10393; F02M 25/028; F02M 25/0227

See application file for complete search history.

(56) References Cited

U.S. PATENT DOCUMENTS

| | | | |
|---|---|---|---|
| 4,790,277 | A | 12/1988 | Schechter |
| 5,148,776 | A | 9/1992 | Connor |

(Continued)

FOREIGN PATENT DOCUMENTS

| | | | |
|---|---|---|---|
| EP | 2607647 | A1 | 6/2013 |

OTHER PUBLICATIONS

McQuillen, Michael, et al., "Method and System for Engine Water Injection," U.S. Appl. No. 15/384,150, filed Dec. 19, 2016, 48 pages.

(Continued)

*Primary Examiner* — Hieu T Vo
*Assistant Examiner* — Arnold Castro
(74) *Attorney, Agent, or Firm* — Julia Voutyras; McCoy Russell LLP

(57) ABSTRACT

Methods and systems are provided for learning a transport delay for individual cylinders that is associated with maldistribution of water among cylinders during a water injection event. Differences in knock intensity between individual cylinders, following a water injection, are used to identify water maldistribution. Differences in the amount and timing of an engine dilution effect following a manifold water injection are learned via an intake oxygen sensor and used to reduce cylinder-to-cylinder imbalance in water delivery.

20 Claims, 4 Drawing Sheets

(51) Int. Cl.

| | |
|---|---|
| ***F02M 35/104*** | (2006.01) |
| ***F02M 35/10*** | (2006.01) |
| ***F02D 41/00*** | (2006.01) |
| ***F02D 41/24*** | (2006.01) |

(56) References Cited

U.S. PATENT DOCUMENTS

| | | | | |
|---|---|---|---|---|
| 5,832,880 | A | 11/1998 | Dickey | |
| 6,026,641 | A | 2/2000 | Liberty | |
| 7,426,918 | B2 * | 9/2008 | Brehob | F02D 17/02 123/295 |
| 7,802,563 | B2 | 9/2010 | Behr et al. | |
| 7,823,563 | B2 | 11/2010 | Jankovic et al. | |
| 8,522,760 | B2 | 9/2013 | Soltis | |
| 8,763,594 | B2 | 7/2014 | Surnilla et al. | |
| 8,960,133 | B2 | 2/2015 | Leone et al. | |
| 9,127,607 | B2 | 9/2015 | Glugla et al. | |
| 9,169,755 | B2 | 10/2015 | Ulrey et al. | |
| 9,291,125 | B2 | 3/2016 | Yoshihara et al. | |
| 9,856,799 | B1 * | 1/2018 | McQuillen | F02D 35/0092 |
| 2010/0121559 | A1 | 5/2010 | Bromberg et al. | |
| 2011/0174267 | A1 | 7/2011 | Surnilla et al. | |
| 2013/0206100 | A1 * | 8/2013 | Yacoub | F02B 47/02 123/25 A |
| 2013/0218438 | A1 | 8/2013 | Surnilla et al. | |
| 2014/0366508 | A1 | 12/2014 | Ulrey et al. | |
| 2015/0101564 | A1 | 4/2015 | Surnilla et al. | |
| 2015/0300296 | A1 * | 10/2015 | Mulye | F02M 25/07 123/676 |
| 2015/0354437 | A1 * | 12/2015 | Mulye | F02B 47/02 123/25 C |
| 2016/0131048 | A1 * | 5/2016 | Surnilla | F02D 41/0025 701/104 |
| 2016/0138527 | A1 | 5/2016 | Guo et al. | |
| 2017/0198661 | A1 * | 7/2017 | Steiner | F02B 17/005 |
| 2018/0022339 | A1 * | 1/2018 | Leone | F02M 25/03 701/22 |
| 2018/0038300 | A1 * | 2/2018 | Hakeem | F02D 41/1444 |
| 2018/0094593 | A1 * | 4/2018 | Leone | F01N 3/10 |
| 2018/0171864 | A1 * | 6/2018 | Hakeem | F02B 29/0493 |
| 2018/0171934 | A1 * | 6/2018 | McQuillen | F02M 25/0227 |
| 2018/0171936 | A1 * | 6/2018 | McQuillen | F02M 25/0227 |
| 2018/0171937 | A1 * | 6/2018 | Shelby | F02M 25/0227 |

OTHER PUBLICATIONS

McQuillen, Michael, et al., "Method and System for Engine Water Injection," U.S. Appl. No. 15/384,188, filed Dec. 19, 2016, 50 pages.

McQuillen, Michael, et al., "Method and System for Adjusting Engine Water Injection," U.S. Appl. No. 15/384,204, filed Dec. 19, 2016, 75 pages.

McQuillen, Michael, et al., "Method and System for Adjusting Engine Water Injection," U.S. Appl. No. 15/384,223, filed Dec. 19, 2016, 77 pages.

Shelby, Michael Howard, et al., "Method and System for Engine Water Injection," U.S. Appl. No. 15/384,243, filed Dec. 19, 2016, 55 pages.

Hakeem, Mohannad, et al., "Method and System for Water Injection Control," U.S. Appl. No. 15/384,253, filed Dec. 19, 2016, 45 pages.

* cited by examiner

METHOD AND SYSTEM FOR PULSED ENGINE WATER INJECTION

FIELD

The present description relates generally to methods and systems for injecting water into an engine and adjusting engine operation based on the water injection.

BACKGROUND/SUMMARY

Internal combustion engines may include water injection systems that inject water into a plurality of locations, including an intake manifold, upstream of engine cylinders, or directly into engine cylinders. Injecting water into the engine intake air may increase fuel economy and engine performance, as well as decrease engine emissions. When water is injected into the engine intake or cylinders, heat is transferred from the intake air and/or engine components to the water. This heat transfer leads to evaporation, which results in cooling. Injecting water into the intake air (e.g., in the intake manifold) lowers both the intake air temperature and a temperature of combustion at the engine cylinders. By cooling the intake air charge, a knock tendency may be decreased without enriching the combustion air-fuel ratio. This may also allow for a higher compression ratio, advanced ignition timing, and decreased exhaust temperature. As a result, fuel efficiency is increased. Additionally, greater volumetric efficiency may lead to increased torque. Furthermore, lowered combustion temperature with water injection may reduce NOx, while a more efficient fuel mixture may reduce carbon monoxide and hydrocarbon emissions.

The injection of water into an engine typically includes the dispensing of water in a constant stream. However the inventors herein have recognized that such an injection may result in improper mixing of the injected water into the air path. In particular, manifold water injection may result in uneven water distribution amongst cylinders coupled to the manifold. For example, water injected upstream of a group of cylinders may not distribute evenly to each of the cylinders due to evaporation, mixing, and entrainment issues, in addition to the airflow maldistribution among cylinders. Further, due to differences in architecture of the engine (e.g., differences in the location, size, and arrangement of intake runners of cylinders within a cylinder group), maldistribution of water amongst the cylinders may occur. Further still, maldistribution of water may occur due to differences in the angle of the manifold water injector upstream of a group of cylinders relative to each runner. If the angle of the water injector or the arrangement of the runner is such that a portion of the injected water puddles, then the water injection benefits of that portion of the injected water may be lost. As a result, uneven charge cooling may be provided to the engine cylinders. In some cases, this may aggravate any existing cylinder-to-cylinder imbalance (e.g., due to air-to-Fuel ratio imbalance, coolant temperature maldistribution, etc). Overall, the maldistribution can result in the full potential of the water injection not being realized (for example, due to the full extent of charge air cooling not being achieved).

In one example, the above issues may be at least partly addressed by a method for an engine comprising: injecting water into an engine intake manifold as a plurality of pulses from a water injector, the pulsing adjusted with reference to intake valve timing based on output from an intake manifold oxygen sensor. In this way, cylinder-to-cylinder water injection imbalances may be better learned and compensated for.

As an example, during conditions when water injection is enabled, such as at high engine loads, water may be injected into an engine intake manifold as a plurality of uniform, evenly spaced pulses whose phasing coincides with the intake valve opening timing of the engine cylinders receiving the injected water. Based on knock sensor output following the injecting, cylinder-to-cylinder variations in water distribution may be inferred. For example, imbalance may be inferred due to different knock intensities in each cylinder following the common water injection. The cylinder-to-cylinder variations in water distribution may be due to variations in the transport delay between the location of water injection and the individual cylinders, which in turn may be based on, as an example, differences in geometry between the runners or water injectors of the individual cylinders. To learn the imbalance, water may be pulsed into the engine intake manifold with a phasing based on the intake valve opening timing of the engine cylinders and further based on their learned knock intensities. Further, based on a deviation between an expected manifold dilution following the injecting relative to an actual dilution (as inferred based on the output of an intake oxygen sensor), individual cylinder transport delays may be learned. The transport delays may then be compensated for during a subsequent water injection by adjusting a timing and amount of the phasing of the individual water pulses. For example, water injection amounts may be increased to compensate for potential water puddles, while water injection timing may be advanced to compensate for water transport lags.

In this way, maldistribution of water between engine cylinders may be better quantified and compensated for. The technical effect of relying on a change in the output of an intake oxygen sensor following a water injection to estimate the maldistribution is that a time and amount of change in engine dilution can be correlated with transport delays to specific cylinders. As a result, air, fuel, and water to the corresponding cylinder can be appropriately adjusted to reduce knock issues and improve the cooling effect and dilution effect of the water injection. Overall, the benefits of water injection may be extended over a wider range of engine operating conditions, improving engine efficiency.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

The following description relates to systems and methods for improving the usage of water from a water injection system coupled to a vehicle engine, as described with reference to the vehicle system of FIG. 1. The engine system may be configured with water injectors at various locations, as illustrated with reference to FIGS. 2-4, to provide diverse water injection benefits such as charge air cooling, engine component cooling, and engine dilution. A controller may be configured to perform a control routine, such as the example routine of FIG. 5, to learn and compensate for an imbalance in water distribution across cylinders due to differences in airflow amounts, pressures, and architectures of each cylinder. The controller may learn transport delays for individual cylinders via an intake oxygen sensor based on an amount and timing of a dilution effect following a pulsed manifold water injection. Accordingly, water injection amounts and timings relative to cylinder intake valve timings may be adjusted to reduce the cylinder-to-cylinder imbalance, as illustrated with reference to the example water injection of FIG. 6. By enabling more even water distribution among cylinders, water injection benefits may be extended. As a result, water usage may be improved to enable significant fuel economy improvements to the vehicle's performance.

Figure 1:
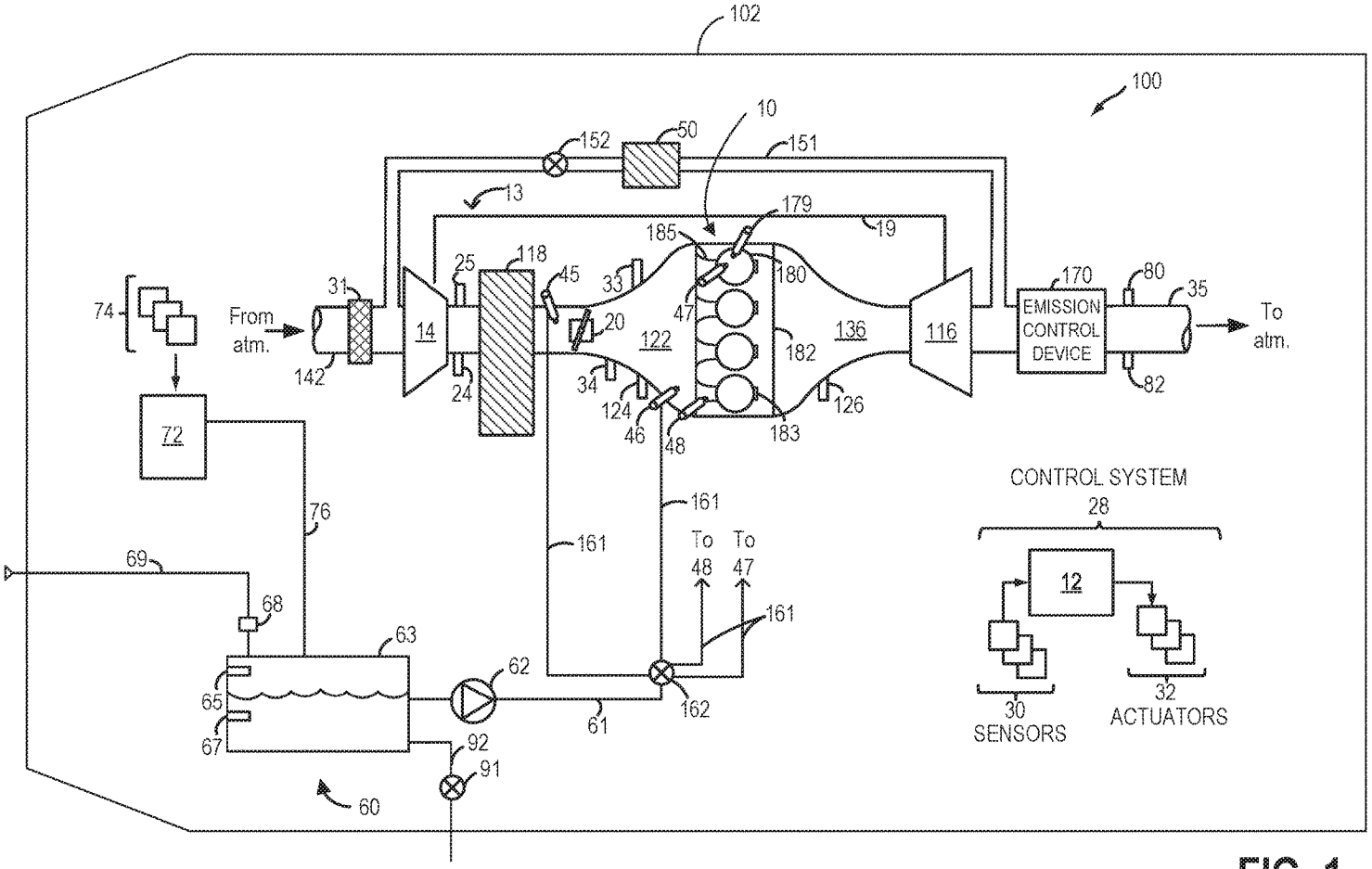
FIG. 1 shows a schematic diagram of an engine system configured for water injection.

FIG. 1 shows an example embodiment of an engine system 100 configured with a water injection system 60. Engine system 100 is coupled in motor vehicle 102, illustrated schematically. Engine system 100 includes an engine 10, depicted herein as a boosted engine coupled to a turbocharger 13 including a compressor 14 driven by a turbine 116. Specifically, fresh air is introduced along intake passage 142 into engine 10 via air cleaner 31 and flows to compressor 14. The compressor may be a suitable intake-air compressor, such as a motor-driven or driveshaft driven supercharger compressor. In the engine system 100, the compressor is shown as a turbocharger compressor mechanically coupled to turbine 116 via a shaft 19, the turbine 116 driven by expanding engine exhaust. In one embodiment, the compressor and turbine may be coupled within a twin scroll turbocharger. In another embodiment, the turbocharger may be a variable geometry turbocharger (VGT), where turbine geometry is actively varied as a function of engine speed and other operating conditions.

As shown in FIG. 1, compressor 14 is coupled, through charge air cooler (CAC) 118 to throttle valve (e.g., intake throttle) 20. The CAC may be an air-to-air or air-to-coolant heat exchanger, for example. Throttle valve 20 is coupled to engine intake manifold 122. From the compressor 14, the hot compressed air charge enters the inlet of the CAC 118, cools as it travels through the CAC, and then exits to pass through the throttle valve 20 to the intake manifold 122. In the embodiment shown in FIG. 1, the pressure of the air charge within the intake manifold is sensed by manifold absolute pressure (MAP) sensor 124 and a boost pressure is sensed by boost pressure sensor 24. A compressor by-pass valve (not shown) may be coupled in series between the inlet and the outlet of compressor 14. The compressor by-pass valve may be a normally closed valve configured to open under selected operating conditions to relieve excess boost pressure. For example, the compressor by-pass valve may be opened responsive to compressor surge.

Intake manifold 122 is coupled to a series of combustion chambers or cylinders 180 through a series of intake valves (not shown) and intake runners (e.g., intake ports) 185. As shown in FIG. 1, the intake manifold 122 is arranged upstream of all combustion chambers 180 of engine 10. Additional sensors, such as manifold charge temperature (MCT) sensor 33 and air charge temperature sensor (ACT) 25 may be included to determine the temperature of intake air at the respective locations in the intake passage. The air temperature may be further used in conjunction with an engine coolant temperature to compute the amount of fuel that is delivered to the engine, for example.

Each combustion chamber may further include a knock sensor 183 for identifying and differentiating abnormal combustion events, such as knock and pre-ignition. In alternate embodiments, one or more knock sensors 183 may be coupled to selected locations of the engine block. Further, as explained further below with reference to FIG. 5, an output of the knock sensors may be used to detect maldistribution of water to individual engine cylinders, where the water is injected upstream of all the combustion chambers 180.

The combustion chambers are further coupled to exhaust manifold 136 via a series of exhaust valves (not shown). The combustion chambers 180 are capped by cylinder head 182 and coupled to fuel injectors 179 (while only one fuel injector is shown in FIG. 1, each combustion chamber includes a fuel injector coupled thereto). Fuel may be delivered to fuel injector 179 by a fuel system (not shown) including a fuel tank, a fuel pump, and a fuel rail. Fuel injector 179 may be configured as a direct injector for injecting fuel directly into combustion chamber 180, or as a port injector for injecting fuel into an intake port upstream of an intake valve of the combustion chamber 180.

In the depicted embodiment, a single exhaust manifold 136 is shown. However, in other embodiments, the exhaust manifold may include a plurality of exhaust manifold sections. Configurations having a plurality of exhaust manifold sections may enable effluent from different combustion chambers to be directed to different locations in the engine system. Universal Exhaust Gas Oxygen (UEGO) sensor 126 is shown coupled to exhaust manifold 136 upstream of turbine 116. Alternatively, a two-state exhaust gas oxygen sensor may be substituted for UEGO sensor 126.

As shown in FIG. 1, exhaust from the one or more exhaust manifold sections is directed to turbine 116 to drive the turbine. When reduced turbine torque is desired, some exhaust may be directed instead through a waste gate (not shown), by-passing the turbine. The combined flow from the turbine and the waste gate then flows through emission control device 170. In general, one or more emission control devices 170 may include one or more exhaust after-treatment catalysts configured to catalytically treat the exhaust flow, and thereby reduce an amount of one or more substances in the exhaust flow.

All or part of the treated exhaust from emission control device 170 may be released into the atmosphere via exhaust conduit 35. Depending on operating conditions, however, some exhaust may be diverted instead to an exhaust gas recirculation (EGR) passage 151, through EGR cooler 50 and EGR valve 152, to the inlet of compressor 14. In this manner, the compressor is configured to admit exhaust tapped from downstream of turbine 116. The EGR valve 152 may be opened to admit a controlled amount of cooled exhaust gas to the compressor inlet for desirable combustion and emissions-control performance. In this way, engine system 100 is adapted to provide external, low-pressure (LP)

EGR. The rotation of the compressor, in addition to the relatively long LP EGR flow path in engine system 100, provides excellent homogenization of the exhaust gas into the intake air charge. Further, the disposition of EGR take-off and mixing points provides effective cooling of the exhaust gas for increased available EGR mass and increased performance. In other embodiments, the EGR system may be a high pressure EGR system with EGR passage 151 connecting from upstream of the turbine 116 to downstream of the compressor 14. In some embodiments, the MCT sensor 33 may be positioned to determine the manifold charge temperature, wherein the charge may include air and exhaust recirculated through the EGR passage 151.

Intake manifold 122 may further include an intake gas oxygen sensor 34. In one example, the oxygen sensor is a UEGO sensor. The intake gas oxygen sensor may be configured to provide an estimate regarding the oxygen content of fresh air received in the intake manifold. In addition, when EGR is flowing, a change in oxygen concentration at the sensor may be used to infer an EGR amount and used for accurate EGR flow control. In the depicted example, oxygen sensor 34 is positioned downstream of throttle 20 and downstream of charge air cooler 118. However, in alternate embodiments, the oxygen sensor may be positioned upstream of the throttle. Intake oxygen sensor 34 may be used for estimating an intake oxygen concentration and inferring an amount of EGR flow through the engine based on a change in the intake oxygen concentration upon opening of the EGR valve 152. Likewise, intake oxygen sensor 34 may be used for estimating an intake oxygen concentration and inferring an engine dilution or a change in intake humidity based on a change in the intake oxygen concentration following an intake manifold water injection.

Specifically, a change in the output of the sensor upon opening the EGR valve or upon injecting water into the intake manifold is compared to a reference point where the sensor is operating with no EGR or no water injection (the zero point). Based on the change (e.g., decrease) in oxygen amount from the time of operating with no EGR or no water injection, an EGR flow or water flow currently provided to the engine can be calculated. For example, upon applying a reference voltage (Vs) to the sensor, a pumping current (Ip) is output by the sensor. The change in oxygen concentration may be proportional to the change in pumping current (delta Ip) output by the sensor in the presence of EGR or water relative to sensor output in the absence of EGR or water (the zero point). Based on a deviation of the estimated EGR flow from the expected (or target) EGR flow, further EGR control may be performed. Likewise, as elaborated with reference to FIG. 5, based on a deviation of the estimated engine dilution or humidity from an expected engine dilution or humidity following a water injection, further water injection control may be performed. In addition, based on a deviation of the timing of the water injection (estimated with reference to an intake valve opening timing of a cylinder) relative to a timing of the change in the engine dilution or humidity (also estimated with reference to the intake valve opening timing of the cylinder), a transport delay for the water injection at the given cylinder may be learned and compensated for during future water injection events.

It will be appreciated that the intake oxygen sensor 34 may be operated in various modes based on the engine operating conditions and further based on the nature of the estimation being performed by the sensor. For example, during engine fueling conditions when dilution/EGR estimation is required, the intake oxygen sensor may be operated in a nominal mode with a (fixed) reference voltage applied to the sensor, the reference voltage maintained during the sensing. In one example, the reference voltage may be 450 mV. During other conditions, such as during engine non-fueling conditions (e.g., during a DFSO), when ambient humidity (in the intake aircharge) estimation is required, the intake oxygen sensor may be operated in a variable voltage mode with the reference voltage applied to the sensor modulated. In still another example, the sensor may be operated in the variable voltage mode when EGR or dilution estimation is performed while fuel vapor purge (from a fuel system canister) or positive crankcase ventilation (of the engine crankcase) is enabled. Therein, the reference voltage of oxygen sensor is modulated to reduce the hydrocarbon effect of the purge on the intake oxygen sensor. In one example, the reference voltage may be modulated between the nominal reference voltage of 450 mV and a higher reference voltage of 800 mV (or 950 mV). By changing the intake oxygen sensor's reference voltage, or Nernst voltage, the sensor goes from reacting hydrocarbons with ambient oxygen at the sensor to dissociating the products of the reaction (water and carbon dioxide). In addition, the reference voltage may be modulated between the higher voltage and the lower voltage, in the presence and absence of HCs from purge and PCV air, to estimate a purge and PCV content in the intake aircharge. In another example, as elaborated herein, water injector pulsations may be detected by the intake oxygen sensor while operating at the nominal reference voltage or while operating in the variable voltage mode. In still another example, fuel injection imbalances may be detected by the intake oxygen sensor while operating in the variable voltage mode.

In particular, the amount of water measured by the oxygen sensor varies with the operating reference voltages. These changes are quantified by characterizing the sensor at varied operating conditions with varied amounts of injected water. Through this characterization, the estimation of the amount of water received in the engine can be corrected across the range of operating reference voltages. The sensor's reference voltage is changed to measure the concentration of water which is then compared against the expected concentration of water following a water injection to determine a water injection maldistribution between cylinders.

Combustion chamber 180 also receives water and/or water vapor via water injection system 60. Water from water injection system 60 may be injected into the engine intake or directly into the combustion chambers 180 by one or more of water injectors 45-48. As one example, water may be injected into intake manifold 122, upstream of throttle 20, via water injector 45, herein also referred to as central water injection. As another example, water may be injected into intake manifold 122, downstream of the throttle in one or more locations, via water injector 46. As yet another example, water may be injected into one or more intake runners (e.g., intake ports) 185 via water injector 48 (herein also referred to as port water injection), and/or directly into combustion chamber 180 via water injector 47 (herein also referred to as direct water injection). In one embodiment, injector 48 arranged in the intake runners may be angled toward and facing the intake valve of the cylinder which the intake runner is attached to. As a result, injector 48 may inject water directly onto the intake valve, resulting in faster evaporation of the injected water and a higher dilution benefit from the water vapor. In another embodiment, injector 48 may be angled away from the intake valve and arranged to inject water against the intake air flow direction through the intake runner. As a result, more of the injected water may be entrained into the air stream, thereby increasing the charge cooling benefit of the water injection. Example configurations of water injectors is elaborated with reference to FIGS. 2-4.

Though only one representative injector 47 and injector 48 are shown in FIG. 1, each of combustion chamber 180 and intake runner 185 may include its own injector. In alternate embodiments, water injection system 60 may include water injectors positioned at one or more of these positions. For example, the engine may include only water injector 46, in one embodiment. In another embodiment, the engine may include each of water injector 46, water injectors 48 (one at each intake runner), and water injectors 47 (one at each combustion chamber).

Water injection system 60 may include a water storage tank 63, a water lift pump 62, a collection system 72, and a water filling passage 69. Water stored in water tank 63 is delivered to water injectors 45-48 via water passage 61 and conduits or lines 161. In embodiments that include multiple injectors, water passage 61 may contain a valve 162 (e.g., diverter valve, multi-way valve, proportioning valve, etc.) to direct water to the different water injectors via the corresponding conduits. Alternatively, each conduit (or water line) 161 may include respective valves within the water injectors 45-48, for adjusting water flow there-through. In addition to water lift pump 62, one or more additional pumps may be provided in conduits 161 for pressurizing the water directed to the injectors, such as in the conduit coupled to direct water injector 47.

Water storage tank 63 may include a water level sensor 65 and a water temperature sensor 67, which may relay information regarding water conditions to controller 12. For example, in freezing conditions, water temperature sensor 67 detects whether the water in tank 63 is frozen or available for injection. In some embodiments, an engine coolant passage (not shown) may be thermally coupled with storage tank 63 to thaw frozen water. The level of water stored in water tank 63, as identified by water level sensor 65, may be communicated to the vehicle operator and/or used to adjust engine operation. For example, a water gauge or indication on a vehicle instrument panel (not shown) may be used to communicate the level of water. If the level of water in the water tank 63 is higher than a threshold level, it may be inferred that there is sufficient water available for injection, and accordingly water injection may be enabled by the controller. Else, if the level of water in the water tank 63 is lower than the threshold level, it may be inferred that there is insufficient water available for injection, and therefore water injection may be disabled by the controller.

In the depicted embodiment, water storage tank 63 may be manually refilled via water filling passage 69 and/or refilled automatically by the collection system 72 via water tank filling passage 76. Collection system 72 may be coupled to one or more vehicle components 74 so that the water storage tank can be refilled on-board the vehicle with condensate collected from various engine or vehicle systems. In one example, collection system 72 may be coupled with an EGR system and/or exhaust system to collect water condensed from exhaust passing through the system. In another example, collection system 72 may be coupled with an air conditioning system (not shown) for collected water condensed from air passing through an evaporator. In yet another example, collection system 72 may be coupled with an external vehicle surface to collect rain or atmospheric condensation. Manual filling passage 69 may be fluidically coupled to a filter 68, which may remove some impurities contained in the water. A drain 92 including a drain valve 91 may be used to drain water from the water storage tank 63 to a location outside the vehicle (e.g., onto the road), such as when a quality of the water is deemed to be lower than a threshold and not suitable for injection into the engine (e.g., due to high conductivity, high particulate matter content). In one example, the quality of the water may be assessed based on the output of a sensor coupled to water injection system 60, in water line 61. For example, the water quality may be assessed based on the output of a conductivity sensor, a capacitance sensor, optical sensor, turbidity sensor, density sensor, or some other type of water quality sensor.

FIG. 1 further shows a control system 28. Control system 28 may be communicatively coupled to various components of engine system 100 to carry out the control routines and actions described herein. Control system 28 may include an electronic digital controller 12. Controller 12 may be a microcomputer, including a microprocessor unit, input/output ports, an electronic storage medium for executable programs and calibration values, random access memory, keep alive memory, and a data bus. Controller 12 may receive input from a plurality of sensors 30, such as the various sensors of FIG. 1, to receive input including transmission gear position, accelerator pedal position, brake demand, vehicle speed, engine speed, mass airflow through the engine, boost pressure, ambient conditions (temperature, pressure, humidity), etc. Other sensors include CAC 118 sensors, such as CAC inlet air temperature, ACT sensor 125, exhaust pressure and temperature sensors 80, 82, and pressure sensor 124, CAC outlet air temperature sensor, and MCT sensor 33, intake oxygen sensor (IAO2) 34, knock sensor 183 for determining ignition of end gases and/or water distribution among cylinders, and others. The controller 12 receives signals from the various sensors of FIG. 1 and employs the various actuators of FIG. 1 to adjust engine operation based on the received signals and instructions stored on a memory of the controller. For example, injecting water to the engine may include adjusting a pulse-width of injectors 45-48 to vary an amount of water injected while also adjusting a timing of the water injection and a number of injection pulses. In some examples, the storage medium may be programmed with computer readable data representing instructions executable by the processor for performing the methods described below (e.g., at FIG. 5) as well as other variants that are anticipated but not specifically listed.

In this way, the system of FIG. 1 enables a vehicle system comprising: an engine including an intake manifold and a plurality of cylinders; a water injector coupled to the intake manifold; an oxygen sensor coupled to the intake manifold; a knock sensor coupled to the plurality of cylinders; and a controller including non-transitory memory with computer readable instructions for: injecting water into the intake manifold as a plurality of pulses, a phasing of the pulses adjusted with reference to an intake valve opening timing of the plurality of cylinders, the phasing adjusted based on input from each of the knock sensor and the oxygen sensor.

Figure 2:
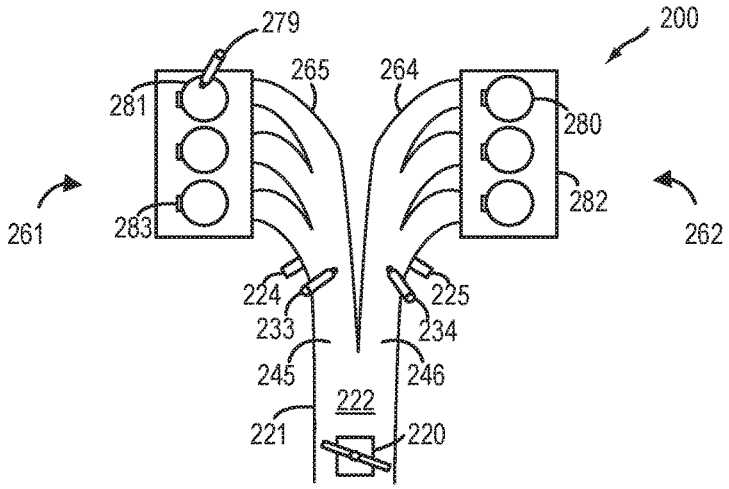
FIG. 2 shows a schematic diagram of a first embodiment of a water injector arrangement for an engine.
Figure 3:
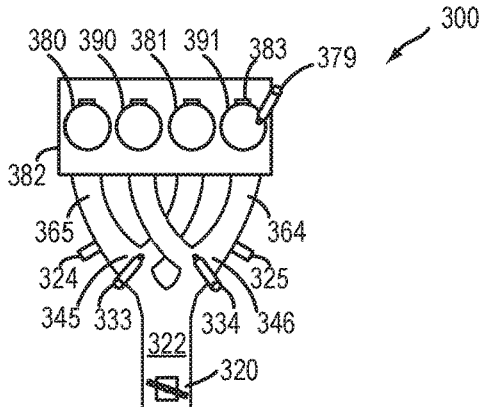
FIG. 3 shows a schematic diagram of a second embodiment of a water injector arrangement for an engine.
Figure 4:
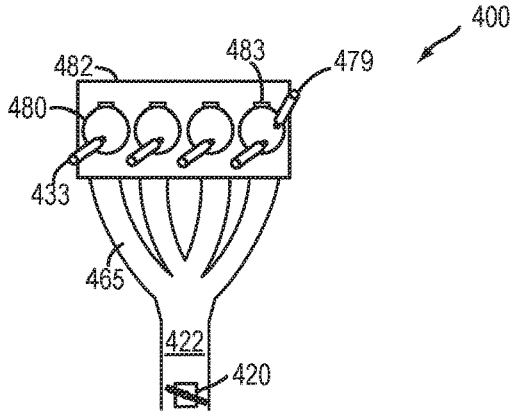
FIG. 4 shows a schematic diagram of a third embodiment of a water injector arrangement for an engine.

FIGS. 2-4 show different embodiments of an engine and example placements of water injectors within the engine. The engines 200, 300, and 400 shown in FIGS. 2-4 may have similar elements to engine 10 shown in FIG. 1 and may be included in an engine system, such as engine system 100 shown in FIG. 1. As such, similar components in FIGS. 2-4 to those of FIG. 1 are not re-described below for the sake of brevity.

A first embodiment of a water injector arrangement for an engine 200 is depicted in FIG. 2 in which water injectors 233 and 234 are positioned downstream of where an intake passage 221 branches to different cylinder groups. Specifically, engine 200 is a V-engine with a first cylinder bank 261 including a first group of cylinders 281 and a second cylinder bank 260 including a second group of cylinders 280. The intake passage branches from a common intake manifold 222 to a first manifold 245 coupled to intake runners 265 of the first group of cylinders 281 and to a second manifold 246 coupled to intake runners 264 of the second group of cylinders 280. Thus, intake manifold 222 is located upstream of all the cylinders 281 and cylinders 280. Further, throttle valve 220 is coupled to intake manifold 222. Manifold charge temperature (MCT) sensors 224 and 225 may be included downstream of the branch point in the first manifold 245 and second manifold 246, respectively, to measure the temperature of intake air at their respective manifolds. For example, as shown in FIG. 2, MCT sensor 224 is positioned within first manifold 245, proximate to water injector 233, and MCT sensor 225 is positioned within second manifold 246, proximate to water injector 234.

Each of cylinders 281 and cylinders 280 include a fuel injector 279 (as shown in FIG. 2 coupled to one representative cylinder). Each of cylinders 281 and cylinders 280 may further include a knock sensor 283 for identifying abnormal combustion events. Additionally, as described further below, comparing the outputs of each knock sensor in a cylinder group may enable a determination of maldistribution of water between cylinders of that cylinder group. For example, comparing outputs of knock sensors 283 coupled to each of cylinders 281 may allow a controller of the engine to determine how much water from injector 233 was received by each of cylinders 281. Due to the intake runners 265 being arranged at different lengths to the injector 233 and different conditions of each intake runner (e.g., airflow levels and pressure), water may not be evenly distributed to each of the cylinders 281 following an injection from injector 233.

Water may be delivered to water injectors 233 and 234 by a water injection system (not shown), like water injection system 60 described above with reference to FIG. 1. Furthermore, a controller, such as controller 12 of FIG. 1, may control injection of water into injectors 233 and 234 individually based on operating conditions of the individual manifolds that the injectors are coupled to. For example, MCT sensor 224 may also include a pressure and/or airflow sensor for estimating an airflow rate (or amount) of airflow at the first manifold 245 and a pressure in the first manifold 245. Similarly, MCT sensor 225 may also include a pressure and/or airflow sensor for estimating an airflow rate and/or pressure at the second manifold 246. In this way, each injector 233 and 234 may be actuated to inject a different amount of water based on conditions of the manifold and/or cylinder group the injector is coupled to. A method for learning a water injection transport delay for individual cylinders, and compensating for cylinder-to-cylinder imbalance in water distribution using water injection adjustments is discussed further below with reference to FIG. 5.

In FIG. 3, a second embodiment of a water injector arrangement for an engine 300 is shown. Engine 300 is an in-line engine where a common intake manifold 322, coupled downstream of a throttle valve 320 of a common intake passage, branches into a first manifold 345 of a first group of cylinders including cylinders 380 and 381 and a second manifold 346 of a second group of cylinders including cylinders 390 and 391. The first manifold 345 is coupled to intake runners 365 of a first cylinder 380 and third cylinder 381. The second manifold 346 is coupled to intake runners 364 of a second cylinder 390 and fourth cylinder 391. A first water injector 333 is coupled in the first manifold 345, upstream of cylinders 380 and 381. A second water injector 334 is coupled in the second manifold 346, upstream of cylinder 390 and 391. As such, water injectors 333 and 334 are positioned downstream of the branch point from the intake manifold 322. Manifold charge temperature (MCT) sensors 324 and 325 may be included in first manifold 345 and second manifold 346, proximate to the first water injector 333 and second water injector 334, respectively.

Each of the cylinders includes a fuel injector 379 (one representative fuel injector shown in FIG. 2). Each cylinder may further include a knock sensor 383 for identifying abnormal combustion events and/or a distribution of water among the cylinders in a cylinder group. Water injectors 333 and 334 may be coupled to a water injection system (not shown), like water injection system 60 described in FIG. 1.

In this way, FIGS. 2 and 3 show examples of an engine where multiple water injectors are used to inject water to different groups of cylinders of the engine. For example, a first water injector may inject water upstream of a first group of cylinders and a second water injector may inject water upstream of a different, second group of cylinders. As discussed further below, different water injection parameters (such as water injection amount, timing, pulsing rate, etc.) may be selected for each water injector based on operating conditions of the group of cylinders the injector is coupled upstream from (such as airflow amount, pressure, firing order, etc.), as well as learned individual cylinder water transport delays.

A third embodiment of a water injector arrangement for an engine 400 is depicted in FIG. 4. As in the previous embodiments, in the embodiment of FIG. 4, intake manifold 422 is configured to supply intake air or an air-fuel mixture to plurality of cylinders 480 through a series of intake valves (not shown) and intake runners 465. Each cylinder 480 includes a fuel injector 479 coupled thereto. Each cylinder 480 may further include a knock sensor 483 for identifying abnormal combustion events and/or determining a distribution of water injected upstream of the cylinders. Alternatively, one or more knock sensors may be coupled at distinct locations along an engine block and knock may be determined for a cylinder based on a timing of the knock signal in relation to engine position (e.g., in crank angle degrees or in terms of cylinder stroke).

In the depicted embodiment, water injectors 433 are directly coupled to the cylinders 480 and thus are configured to inject water directly into the cylinders. As shown in FIG. 4, one water injector 433 is coupled to each cylinder 480. In another embodiment, water injectors may be additionally or alternatively positioned upstream of the cylinders 480 in the intake runners 465 and not coupled to each cylinder. Water may be delivered to water injectors 433 by a water injection system (not shown), such as water injection system 60 described in FIG. 1.

In this way, the systems of FIGS. 1-4 present example systems that may be used to inject water into one or more locations in an engine intake or cylinders of an engine. As introduced above, water injection may be used to reduce a temperature of the intake air entering engine cylinders and thereby reduce knock and increase volumetric efficiency of the engine. Injecting water may also be used to increase engine dilution (and charge humidity) and thereby reduce engine pumping losses. As explained above, water may be injected into the engine at different locations, including the intake manifold (upstream of all engine cylinders), manifolds of groups of cylinders (upstream of a group of cylinders, such as in a V-engine), intake runners or ports of engine cylinders, directly into engine cylinders, or a combination thereof. While direct and port injection may provide increased cooling to the engine cylinders and ports, intake manifold injection may increase cooling of the charge air without needing high pressure injectors and pumps (such as those that may be needed for port or direct cylinder injection). However, due to the lower temperature of the intake manifold (as it is further away from the cylinders), not all the water injected at the intake manifold may atomize (e.g., vaporize) properly. In some examples, as shown in FIG. 1, engines may include injectors at multiple locations within the engine intake or engine cylinders. Under different engine load and/or speed conditions it may be advantageous to inject water at one location over another to achieve increased charge air cooling (intake manifold) or dilution (cylinder intake ports/runners). Water injection parameters for each injector may be individually determined based on conditions of the group of cylinders that the injector is coupled to (e.g., airflow to the group of cylinders, pressure upstream of the group of cylinders, etc.). Further, manifold water injection upstream of a group of cylinders (e.g., two or more cylinders) may result in uneven water distribution amongst the cylinders of the group due to differences in architecture or conditions (e.g., pressure, temperature, airflow, etc.) of the individual cylinders in the group. As a result, uneven cooling may be provided to the engine cylinders. In some examples, as explained further below with reference to FIG. 5, maldistribution of water injected upstream of a group of cylinders may be detected and compensated for in response to a comparison of outputs of knock sensors and intake oxygen sensors coupled to each cylinder of the group.

Figure 5:
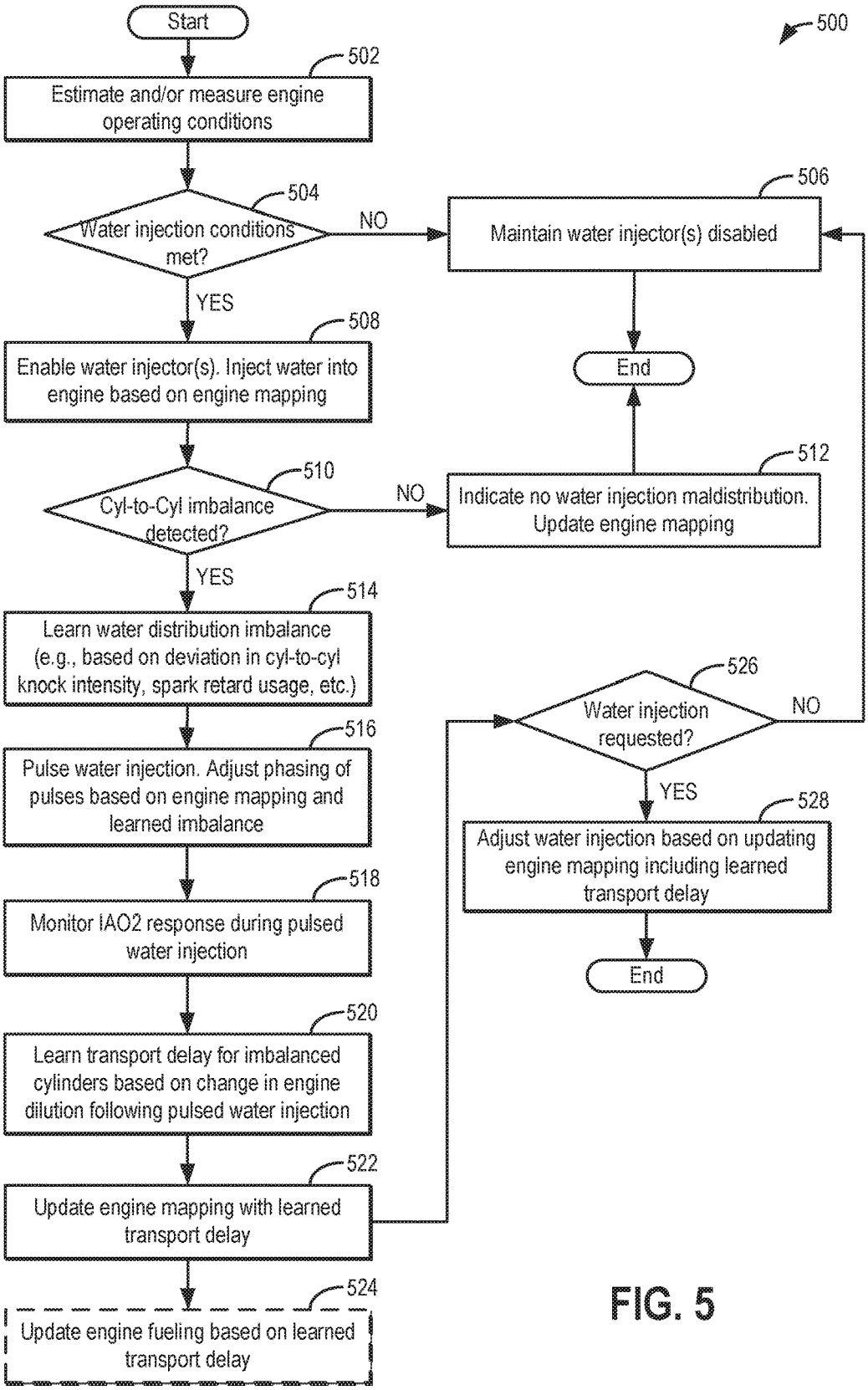
FIG. 5 shows a high level flow chart for addressing water injection maldistribution by learning water injection transport delays to individual cylinders.

Turning to FIG. 5, an example method 500 for injecting water into an engine is depicted. Injecting water may include injecting water via one or more water injectors of a water injection system, such as the water injection system 60 shown in FIG. 1. Instructions for carrying out method 500 and the rest of the methods included herein may be executed by a controller (such as controller 12 shown in FIG. 1) based on instructions stored on a memory of the controller and in conjunction with signals received from sensors of the engine system, such as the sensors described above with reference to FIG. 1, 2, 3, or 4. The controller may employ engine actuators of the engine system to adjust engine operation, according to the methods described below. For example, the controller may send a signal to an actuator for a water injector to vary a pulse-width and timing of a water injection. The method enables water to be injected into an engine intake manifold as a plurality of pulses with the pulsing adjusted, with reference to intake valve timing of cylinders receiving the water, based on feedback from an intake manifold oxygen sensor and a knock sensor.

The method 500 begins at 502 by estimating and/or measuring engine operating conditions. Engine operating conditions estimated may include manifold pressure (MAP), air-fuel ratio (A/F), spark timing, fuel injection amount or timing, an exhaust gas recirculation (EGR) rate, mass air flow (MAF), manifold charge temperature (MCT), engine speed and/or load, driver torque demand, engine temperature, exhaust catalyst temperature, etc.

Next, at 504, the method includes determining whether water injection conditions have been met. Water injection conditions may be considered met responsive to engine load being higher than a threshold load and spark timing being retarded (e.g., from MBT) by more than a threshold amount. Determining whether water injection conditions have been met may also include determining if a water injection has been requested. In one example, water injection may be requested in response to a manifold temperature being greater than a threshold level. Additionally, water injection may be requested when a threshold engine speed or load is reached. In yet another example, water injection may be requested based on an engine knock level being above a threshold (or a cylinder knock propensity being higher than a threshold). Further, water injection may be requested in response to an exhaust gas temperature being above a threshold temperature, where the threshold temperature is a temperature above which degradation of engine components downstream of cylinders may occur. In addition, water may be injected when the inferred octane number of used fuel is below a threshold.

In addition to determining if engine operating conditions that are conducive to water injection are met, the controller may also determine if water is available for injection. Water availability for injection may be determined based on the output of a plurality of sensors, such as a water level sensor and/or water temperature sensor disposed in a water storage tank of a water injection system of the engine (such as water level sensor 65 and water temperature sensor 67 shown in FIG. 1). For example, water in the water storage tank may be unavailable for injection in freezing conditions (e.g., when the water temperature in the tank is below a threshold level, where the threshold level is at or near a freezing temperature). In another example, the level of water in the water storage tank may be below a threshold level, where the threshold level is based on an amount of water required for an injection event or a period of injection cycles. In response to the water level of the water storage tank being below the threshold level, water injection may be disabled and refilling of the tank may be indicated.

If water injection conditions are not confirmed, or if water is not available, at 506, the water injectors are maintained disabled and engine operation continues without injecting water. This includes adjusting engine operating parameters without injecting water. As an example, if water injection was required to reduce knock, but water injection was not possible (e.g., because water was not available), engine operation adjustments may include one or more of enriching the air-fuel ratio of the knocking cylinder, reducing an amount of throttle opening to decrease manifold pressure, and retarding spark timing of the knocking cylinder to address the knock.

If water injection conditions are confirmed, and water is available, the method continues at 508 to enable the water injectors. As an example, a manifold water injector configured to inject water into the intake manifold may be enabled. The injector may then deliver water evenly to all engine cylinders downstream of the injector, or adjust the water delivery based on engine mapping data retrieved from the controller's memory. For example, water may be injected as a single pulse per engine cycle (for all intake valve opening events for all cylinders coupled downstream of the injector). As another example, the injector may deliver the water as a series of pulses synchronized to the intake valve opening of each cylinder coupled downstream of the injector. For example, water may be injected into the engine intake manifold as a plurality of evenly spaced pulses having equal amounts of water from the enabled water injector. Alternatively, the pulsing (including a timing and an amount of each water pulse) may be determined as a function of the engine mapping stored in the controller's memory.

In one example configuration, the manifold water injector may inject water into the intake manifold, upstream of each of a first cylinder and a second cylinder. The pulsed water injection may include a first amount of water injected as a first pulse having a timing overlapping with an intake valve opening of the first cylinder and a second amount of water injected as a second pulse having a timing overlapping with an intake valve opening of the second cylinder. Herein the evenly phased first and second pulses may have the same pulse-width. In other examples, where the engine is configured with a first manifold water injector upstream of a first group of cylinders and a second manifold water injector upstream of a second group of cylinders (such as with reference to the injector configurations of FIGS. 2-3), the controller may deliver the water as a first pulse with a first injection amount injected via the first injector upstream of the first group of cylinders and a second pulse with a second injection amount injected via the second injector upstream of the second group of cylinders. Here also the evenly phased first and second pulses may have the same pulse-width.

As an example, the controller may calculate the amount of water to deliver during each pulse for each cylinder or determine a total water injection amount for all cylinders and divide by the number of cylinders. The controller may then determine the timing of each pulse to overlap with the intake valve opening timing of each (corresponding) cylinder.

As discussed earlier, the pulses may alternatively be adjusted based on engine mapping. This includes adjusting the pulses (timing and/or amount) based on differences in cylinder position along an engine block, firing order, air flow, temperature, as well as knock history. The engine mapping data may include data learned during each drive cycle, and updated following each drive cycle. For example, the first and second amounts of water injected in the first and second pulses, respectively, may be individually determined based on operating conditions of the first and second cylinders (or groups of cylinders) such as based on one or more of airflow level or mass air flow to the corresponding cylinders (or group of cylinders), pressure at the corresponding cylinders (or group of cylinders), temperature of the corresponding cylinders (or group of cylinders), a knock level at the corresponding cylinders (or group of cylinders), a fuel injection amount at the corresponding cylinders (or group of cylinders), etc. Herein, the first and second amounts may not be equal. In one example, where the engine mapping indicates that the first cylinder has a higher propensity for knock relative to the second cylinder, the first amount may be increased relative to the second amount. In another example, where the engine mapping indicates that the first cylinder tends to operate at higher average cylinder temperatures relative to the second cylinder, the first amount may be increased relative to the second amount. As still another example, where the engine mapping indicates that the first cylinder tends to receive a smaller mass air flow relative to the second cylinder, the first amount may be increased relative to the second amount.

As used herein, the first and second amounts of water injected in the first and second pulse, as well as the first and second timing of the pulses may correspond to an initial amount and timing of the water injection pulses that is determined based on the engine mapping of the cylinders. As such, each engine may have a different cylinder architecture as well as a distinct intake runner architecture (e.g., geometry) for each cylinder that results in a difference in water distribution to each cylinder (e.g., of a group) from a common water injector. For example, each cylinder of a group of cylinders may be a different distance away from the water injector coupled to the group of cylinders and/or each intake runner may have a different shape or curvature that affects how the injected water is delivered to the corresponding cylinder. Further, the angle of the injector relative to each cylinder may be different within the group of cylinders. Thus, an initial pulsed injection timing and amount of water delivered for each pulse (which may be different for different cylinders within the group) may be determined based on a known architecture of the engine. Due to the variation in water delivery, the charge cooling and dilution effect of an injected water pulse at each cylinder may vary. This may result in differences in knock occurrence. For example, a cylinder that receives less water than intended may knock more (with a higher intensity and/or a higher frequency) than a cylinder that receives more water than intended (or that receives the intended water amount). As elaborated below, an engine water maldistribution is learned based on cylinder-to-cylinder variations in knock following the water injection. By concurrently learning a transport delay for each pulse in the imbalanced cylinders, such as based on variations in the dilution effect of each water pulse, the maldistribution may be compensated for during subsequent water injections.

At 510, after injecting the initial amounts of water at the timings overlapping with the intake valve opening of the corresponding cylinders, it may be determined if any cylinder-to-cylinder imbalance (indicative of water maldistribution) is observed. In one example, cylinder-to-cylinder imbalance is indicated based on differences in the output of a knock sensor coupled to the first cylinder relative to an output of a knock sensor coupled to the second cylinder. For example, if after the first water pulse, the first cylinder knocks more than expected, then it may be determined that the first cylinder received less water than injected. As another example, if after the second water pulse, the second cylinder knocks more than expected, then it may be determined that the second cylinder received less water than injected. The imbalanced cylinders may have received less water than was injected due to, as non-limiting examples, water puddling near the source of injection causing less water to reach the cylinder, differences in cylinder and intake runner architecture resulting in a smaller portion of the injected water reaching the cylinder at the time of intake valve opening, etc. In addition, as introduced above, intake manifold runner architecture may inherently result in uneven distribution of water from an injector to downstream cylinders. In another example, maldistribution of water may occur due to differences in the angle of the water injector upstream of the cylinders relative to each runner. The observed differences in individual cylinder knock intensity may be correlated with cylinder-to-cylinder imbalance in water delivery. In still other examples, cylinder-to-cylinder imbalance may be indicated based on a difference in adaptive spark to each engine cylinder following the water injection. Therein, differences in individual cylinder spark retard usage may be correlated with cylinder-to-cylinder imbalance. For example, if after the first water pulse, the first cylinder has spark timing retarded more than expected, then it may be determined that the first cylinder received less water than injected. As another example, if after the second water pulse, the second cylinder has spark timing retarded more than expected, then it may be determined that the second cylinder received less water than injected.

For example, a standard deviation in knock outputs corresponding to different cylinders may be determined and if the standard deviation is greater than a threshold standard deviation value, water imbalance may be indicated. In yet another example, if a knock output corresponding to an individual cylinder differs from an average value of all knock outputs corresponding to all cylinders of the group, by a threshold amount, the individual cylinder may be indicated as receiving more or less water than the other cylinders in the group. In another example, water maldistribution among a group of cylinders coupled to a water injector may be determined based on differences in spark retard in individual cylinders from an expected amount, the expected amount based on engine mapping.

If no deviations in knock intensity or spark retard usage are observed, then at 512, the method includes indicating that there is no water injection maldistribution. In addition, the engine mapping may be updated based on the most recent estimate of individual cylinder knock intensities and spark retard usage.

If cylinder-to-cylinder imbalance is detected, then at 514, the method includes learning a water distribution imbalance between the cylinders based on the deviation in cylinder-to-cylinder knock intensity or spark retard usage. For example, a water deficit in a cylinder may be learned based on a difference between the actual knock intensity and the expected knock intensity, with the actual knock intensity being higher than the expected knock intensity. As another example, a water deficit in the cylinder may be learned based on a difference between the actual degree of spark timing applied and the expected degree of spark timing retard.

At 516, following the confirmation of water maldistribution, pulsed water injection is repeated to learn a transport delay for each of the imbalanced cylinders. This includes pulsing the water injector disposed in the intake manifold, upstream of an intake manifold oxygen sensor, to deliver an amount of water over a plurality of pulses from the injector. As with the previous water injection, the current water injection may include a first pulse delivered to a first cylinder and a second pulse delivered to a second cylinder. The pulsing may be adjusted with reference to the intake valve timing of the cylinders based on the engine mapping and also based on the knock output following the earlier water injection. Each of a first amount and an initial timing of the first pulse may be adjusted based on the engine mapping and further based on an output of the knock sensor coupled to the first cylinder, following the injecting. Likewise, each of a second amount and an initial timing of the second pulse may be adjusted based on the engine mapping and further based on an output of the knock sensor coupled to the second cylinder, following the injecting In one example, the controller may increase the amount of water injected for a pulse that corresponds to the intake valve opening of a cylinder to compensate for less water detected at that cylinder than others. The lower amount of water detected at the one cylinder relative to the others in the group may be based on the knock sensor output from that cylinder being higher than the other cylinders, or based on the degree of spark retard applied to that cylinder being higher than the spark retard applied to other cylinders. In another example, the controller may decrease the amount of water injected for a pulse that corresponds to the intake valve opening of a cylinder to compensate for more water detected at that cylinder than others. The higher amount of water detected at the one cylinder relative to the others in the group may be based on the knock sensor output from that cylinder being lower than the other cylinders.

At 518, the method includes monitoring the response of the intake oxygen sensor during the pulsed water injection. The intake oxygen sensor may be operated in one of a nominal mode and a variable voltage mode during the pulsed water injection. In one example, the nominal mode of IAO2 sensor operation may be selected during a first pulsed water injection condition. Operating in the nominal mode includes operating the sensor at a fixed reference voltage (e.g., 450 mV) and detect the water injection amount based on the dilution of oxygen. In another example, the variable voltage mode may be selected during a second, different pulsed water injection condition. Operating in the variable voltage mode includes modulating the reference voltage of the sensor between a first, lower reference voltage (e.g., 450 mV) and a second, higher reference voltage (e.g., 950 mV) to detect the water injection amount based on the excess oxygen generated due to the water dissociation at the higher voltage. Since the sensor is configured to sense the presence of oxygen in the intake air, the output of the sensor may change during the pulsed water injection reflecting a change in the dilution or water content (in particular, the oxygen added to the air due to the dissociation of water at the sensor into oxygen) of the air. As such, an amount of dilution corresponding to the amount of water injected a pulse is expected at the intake oxygen sensor at a timing corresponding to intake valve opening of the downstream cylinder. If the amount of the sensed dilution does not matches the expected dilution, and/or the timing of the dilution does not overlap with intake valve opening of the downstream cylinder, it may be due a transport delay in the water injection.

Thus at 520, the method includes learning a transport delay for each of the plurality of pulses (for each of the plurality of cylinders) based on the output from the intake manifold oxygen sensor during the pulsed water injection. As an example, the learning includes, learning a first transport delay for the first pulse to the first cylinder based on the output of the intake manifold oxygen sensor at intake valve opening of the first cylinder, and learning a second transport delay for the second pulse to the second cylinder based on the output of the intake manifold oxygen sensor at intake valve opening of the second cylinder. At 522, the method includes updating the engine mapping stored in the controller's memory with the learned transport delay.

As an example, if the output of the intake manifold oxygen sensor indicates that the expected dilution is not achieved during intake valve opening of the first cylinder, but that a dilution effect occurs later than the intake valve opening, then a transport lag may be learned based on the difference in degree of dilution at the time of intake valve opening (e.g., based on how much lower the actual dilution is than expected at the time of intake valve opening). Additionally or alternatively, the transport lag may be learned based on the difference in timing (herein delay) of the actual dilution effect relative to the expected timing (at intake valve opening). A transport delay for the first cylinder stored in the engine mapping may then be updated with a factor based on the learned transport lag. As another example, if the output of the intake manifold oxygen sensor indicates that the expected dilution is not achieved during intake valve opening of the first cylinder, but that a dilution effect occurs earlier than the intake valve opening, then a transport lead may be learned based on the difference in degree of dilution at the time of intake valve opening (e.g., based on how much higher the actual dilution is than expected at the time of intake valve opening). Additionally or alternatively, the transport lag may be learned based on the difference in timing of the actual dilution effect relative to the expected timing (at intake valve opening). The transport delay for the first cylinder stored in the engine mapping may then be updated with a factor based on the learned transport lead.

In still another example, when the sensor is operated in the variable voltage mode, a difference between the output of the intake manifold oxygen sensor at the lower voltage and the output of the sensor at the higher voltage is reflective of an amount of excess water in the air (due to dissociation of the water at the higher voltage). If the estimated amount of excess water at the time of valve opening is less than the expected water amount (due to the pulsed water injection into a specific group of cylinders), it may be inferred that there is a water maldistribution. Based on a difference between the estimated water amount and the injected water amount, a transport delay may be learned. Additionally or optionally, based on a timing when the estimated water amount matches the injected water amount relative to intake valve opening timing, a transport delay may be learned.

At 524, optionally, the method includes adjusting engine fueling based on the learned transport delay. For example, engine fueling may be adjusted to meet an engine dilution demand while taking into account the amount of dilution provided via the water injection and the transport delay of the water injection. In still further examples, the learned cylinder-to-cylinder imbalance may be compensated for by only adjusting the engine fueling and without adjusting the water injection profile. Further, one or more engine operating parameters other than water injection may be adjusted based on the learned transport delay. For example, if water is injected responsive to an indication of knock, one or more of spark timing, intake valve timing, and exhaust valve timing may be advanced differently amongst a group of cylinders based on the learned transport delay.

From 522 (or 524), the method moves to 526 wherein it is determined if water injection has been requested again. This includes assessing if water injection conditions are met, as previously discussed at 504. If water injection is not requested, then the routine returns to 506 to maintain the water injector(s) disabled and operate the engine with the updated engine mapping. If water injection is requested, at 528, during the subsequent water injection, the method includes adjusting each of the first amount and the initial timing of a first pulse into the first cylinder based on the learned first transport delay (of the first cylinder), and adjusting each of the second amount and the initial timing of a second pulse into the second cylinder based on the learned second transport delay (of the second cylinder). In addition, during the subsequent water injection, the controller may further adjust each of the first amount and the initial timing of the first pulse based on the second transport delay (of the second cylinder), and adjust each of the second amount and the initial timing of the second pulse based on the first transport delay (of the first cylinder).

In this way, water may be injected into an engine intake manifold as a plurality of pulses from a water injector with the pulsing adjusted with reference to intake valve timing based on output from an intake manifold oxygen sensor and a knock sensor. For example, an engine controller may pulse an intake manifold water injector to deliver an amount of water into a group of cylinders, a timing of the pulsing synchronized to an intake valve opening timing of each cylinder of the group of cylinders, the amount and the timing adjusted based on output from each of an intake manifold oxygen sensor and a knock sensor. The pulsing may be performed responsive to an indication of cylinder-to-cylinder imbalance, the indication based on the knock sensor. Herein the pulsing may include initially pulsing the intake manifold water injector to deliver a first amount of water at a first timing synchronized with the intake valve opening timing of each cylinder of the group of cylinders; learning a cylinder-to-cylinder imbalance based on the output from the knock sensor following the initially pulsing; subsequently pulsing the intake manifold water injector to deliver a second amount of water at a second timing based on the learned cylinder-to-cylinder imbalance; learning a transport delay for each pulse of the subsequently pulsing based on the output of the oxygen sensor following the subsequently pulsing; and finally pulsing the intake manifold water injector to deliver a third amount of water at a third timing based on the learned transport delay to reduce the learned cylinder-to-cylinder imbalance. The amount and the timing adjustment of the pulse based on the output from the intake manifold oxygen sensor may include adjusting the amount and timing from an initial amount and an initial timing to a final amount and final timing based on a deviation of an expected engine dilution from an actual engine dilution, the actual engine dilution based on the output of the oxygen sensor, the expected dilution based on the initial amount and further based on the initial timing relative to the intake valve opening timing.

Figure 6:
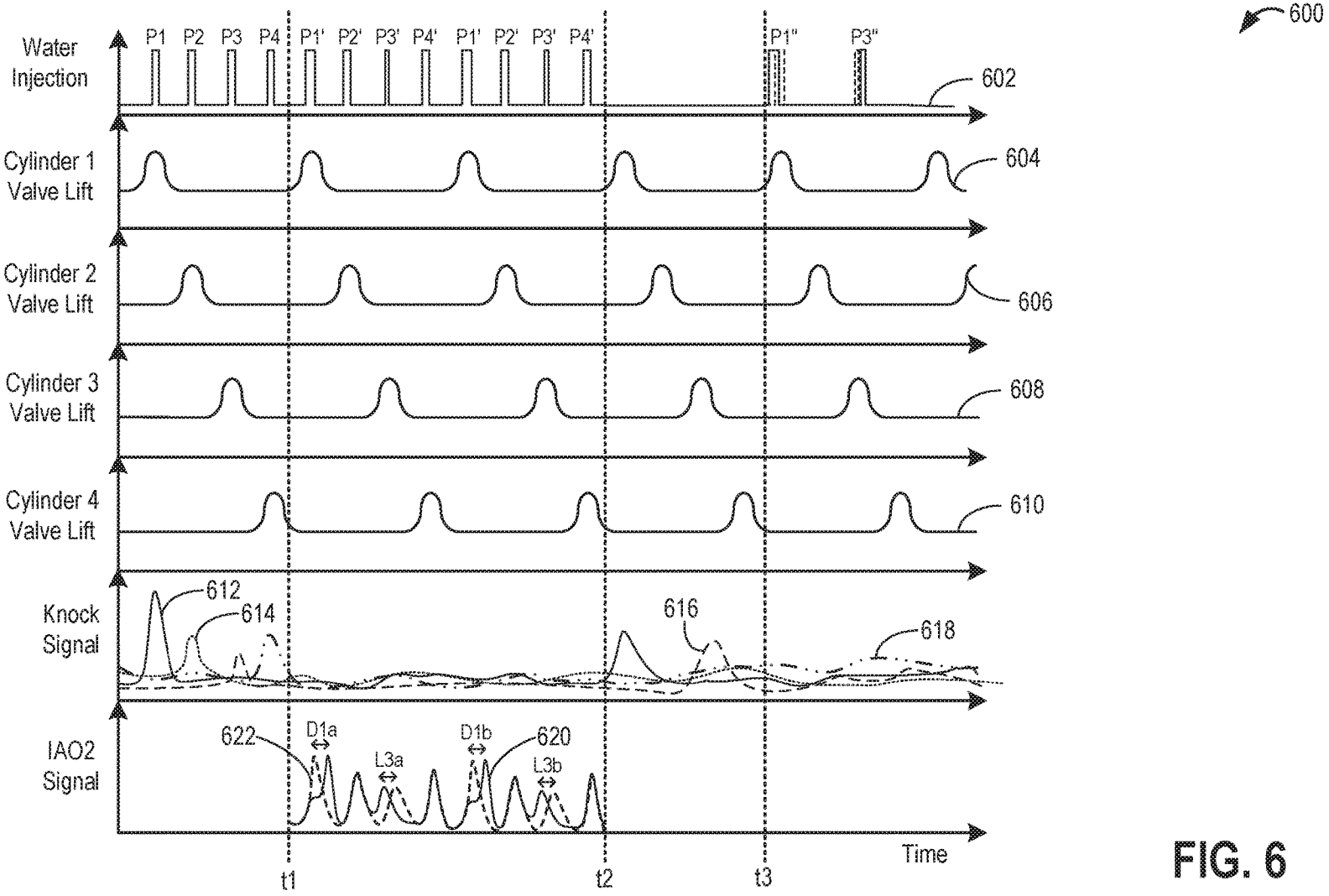
FIG. 6 shows a graph depicting example adjustments to a water injection amount and timing to compensate for water maldistribution between cylinders.

Turning now to FIG. 6, map 600 illustrates adjustments to an amount and timing of a pulsed water injection to reduce uneven distribution of injected water across a group of cylinders coupled to the injector. The adjustments are performed by compensating for individual cylinder water transport delays, as learned based on outputs from an intake manifold oxygen sensor.

The operating parameters illustrated in map 600 include water injection at plot 602, cylinder valve lift for each of four cylinders at 604-610, knock signals (e.g., knock output of a knock sensor) for each of the four cylinders at 612-618, and an intake oxygen (or dilution level) signal (e.g., pumping current output by an intake oxygen sensor) at 620. In the depicted example, water injection pulses are synchronized with the valve lift for each cylinder. Additionally, in this example, water may be injected upstream of all of cylinders 1-4 (such as via a manifold injector positioned in an intake manifold upstream of all of cylinders 1-4). For each operating parameter, time is depicted along the horizontal axis and values of each respective operating parameter are depicted along the vertical axis.

Between t0 and t1, water is injected, evenly, upstream of each cylinder (e.g., in the intake manifold) in response to a water injection request and knock signal intensity is monitored. The water may be injected by pulsing the injector with the same pulse width to produce pulses P1-P4 at times (corresponding to regular intervals) synchronized to the intake valve opening of cylinders 1-4, respectively. In this way, multiple pulses of water may be delivered by a single injector positioned upstream of cylinders 1-4.

Cylinder specific knock signals are monitored between t1 and t4 to map the engine. In the present example, knock signals 612 (solid line) and 616 (long dashed line) for cylinders 1 and 3, respectively, are outside of the average knock intensity while knock signals 614 (small dashed line) and 618 (dashed and dotted line) for cylinders 2 and 4, respectively, are at or around the average knock intensity (expected average knock intensity for the 4 cylinders). In particular, knock signal 612 for cylinder 1 is higher than average indicating that cylinder 1 is more prone to knock, and knock signal 616 for cylinder 3 is lower than average indicating that cylinder 3 is less prone to knock. In other words, cylinders 1 and 3 are imbalanced.

In response to feedback about engine operation from a plurality of sensors, including knock sensors, the controller may map the engine and adaptively adjust the water injection amount or the cylinders. In particular, between t1 and t2, the controller may increase the amount of water injected for cylinder 1, such that pulse P1' has a larger pulse width than corresponding earlier pulse P1. Likewise, the controller may decrease the amount of water injected for cylinder 3, such that pulse P3' has a smaller pulse width than corresponding earlier pulse P3. The pulse width of the injections for cylinders 2 and 4 are maintained, and therefore pulses P2' and P4' have the same pulse width as P2 and P4 respectively. In the present example, pulses P1'-P4' are repeated once. Due to the water injection, between time t1 and t2, knock intensity signal may decrease.

Responsive to the indication of cylinder-to-cylinder imbalance, between t1 and t2, intake oxygen levels (or dilution) are also monitored, based on the output of an intake oxygen sensor. An expected dilution response of the intake oxygen sensor is shown at dashed plot 622. The expected dilution response includes dilution peaks whose amplitude correlates with water pulses P1', P2', P3', and P4'. In addition, the dilution peaks are expected to have a timing that overlaps with the intake valve opening timing of the corresponding cylinders. However, the actual dilution response (depicted at plot 620) varies from the expected dilution response. Specifically, the dilution peak corresponding to pulse P1' has a peak intensity that is delayed from the expected timing, resulting in a delay D1*a* (on the first iteration) and a delay D1*b* (on the second iteration). An average delay D1 for the given cylinder (1) may be learned as a statistical average of delay D1*a* and delay D1*b*. On the other hand, the dilution peak corresponding to pulse P3' has a peak intensity that is earlier than the expected timing, resulting in a lead L3*a* (on the first iteration) and a lead L3*b* (on the second iteration). An average lead L3 for the given cylinder (3) may be learned as a statistical average of lead L3*a* and lead L3*b*. A timing of the dilution peaks for pulses P2 and P4 may correspond to the expected timing. An engine mapping for the cylinders is then updated based on the learned differences in knock intensities, the corresponding cylinder-to-cylinder imbalance, and the corresponding transport lags or leads. A base transport delay factor for each cylinder may be accordingly updated, for example, with a constant that is determined as a function of the learned lag or lead.

Between t2 and t3, water injection is disabled. However, due to a change in engine operating conditions between t2 and t3, cylinders 1 and 3 may knock (as indicated by a rise in their respective knock signals).

To address the knock, after t3, water injection is resumed. However, to reduce cylinder-to-cylinder imbalance due to water maldistribution, a phasing and amplitude of the knock-mitigating water injection pulses are adjusted with the updated engine mapping. For example, cylinder 1 receives water in accordance with pulse P1" having a pulse width that corresponds to the cylinder-adjusted pulse-width of pulse P1'. In addition, a timing of injection of pulse P1" is adjusted to be earlier (than the timing of injection of pulse P1') to compensate for transport lag D1. As another example, cylinder 3 receives water in accordance with pulse P3" having a pulse width that corresponds to the cylinder-adjusted pulse-width of pulse P3'. In addition, a timing of injection of pulse P3" is adjusted to be later (than the timing of injection of pulse P3') to compensate for transport lead L3.

In an alternate example, the controller may compensate for transport lag D1 by further increasing pulse width P1", and compensate for transport lead L3 by further decreasing pulse width P3". In still other examples, the controller may pull ahead the pulse in time. Therein the time is offset to account for the transport delay.

In this way, water injection at an intake manifold may be adjusted in response to uneven water distribution amongst cylinders coupled to an intake manifold. By comparing engine operating conditions, such as knock sensor output between cylinders, following an evenly pulsed water injection, uneven water distribution among the cylinders may be identified. By synchronizing the pulsed manifold water injection to an intake valve opening timing of each cylinder, and monitoring changes in a dilution effect in the intake manifold via an intake oxygen sensor, cylinder-specific transport delays causing the uneven water distribution can be accurately learned and compensated for. The technical effect of then adjusting water injection in response to uneven water distribution based on the learned transport delays is that water injection amounts and timings between cylinders can be adjusted to mitigate the imbalance. By reducing water maldistribution, the desired benefits of water injection, such as decreased knock tendency and increased engine efficiency, may be provided over a wider range of engine operating conditions. In addition, the efficiency of engine water usage can be improved.

An example method for an engine comprises: injecting water into an engine intake manifold as a plurality of pulses from a water injector, the pulsing adjusted with reference to intake valve timing based on output from an intake manifold oxygen sensor. In the preceding example, additionally or optionally, the injecting includes pulsing a water injector disposed in the engine intake manifold, upstream of the intake manifold oxygen sensor, to deliver an amount of water over the plurality of pulses. In any or all of the preceding examples, additionally or optionally, the injecting includes injecting a first amount of water as a first pulse, an initial timing of the first pulse overlapping with intake valve opening of a first cylinder, and injecting a second amount of water as a second pulse, an initial timing of the second pulse overlapping with intake valve opening of a second cylinder. In any or all of the preceding examples, additionally or optionally, the first amount and the second amount are based on an engine mapping of the first and second cylinder, the engine mapping including a location of the first cylinder relative to the second cylinder along an engine block, a firing order of the first cylinder relative to the second cylinder, and a knock history of the first cylinder relative to the second cylinder. In any or all of the preceding examples, additionally or optionally, each of the first amount and the initial timing of the first pulse is further based on output of a knock sensor coupled to the first cylinder, following the injecting, and wherein each of the second amount and the initial timing of the second pulse is further based on output of a knock sensor coupled to the second cylinder, following the injecting. In any or all of the preceding examples, additionally or optionally, the method further comprises learning a transport delay for each of the plurality of pulses based on the output from the intake manifold oxygen sensor. In any or all of the preceding examples, additionally or optionally, the learning includes learning a first transport delay for the first pulse to the first cylinder based on the output of the intake manifold oxygen sensor at intake valve opening of the first cylinder, and learning a second transport delay for the second pulse to the second cylinder based on the output of the intake manifold oxygen sensor at intake valve opening of the second cylinder. In any or all of the preceding examples, additionally or optionally, the method further comprises, during a subsequent water injection, adjusting each of the first amount and the initial timing of the first pulse based on the first transport delay, and adjusting each of the second amount and the initial timing of the second pulse based on the second transport delay. In any or all of the preceding examples, additionally or optionally, the method further comprises, during the subsequent water injection, adjusting each of the first amount and the initial timing of the first pulse based on the second transport delay, and adjusting each of the second amount and the initial timing of the second pulse based on the first transport delay. In any or all of the preceding examples, additionally or optionally, the pulsing is responsive to engine load being higher than a threshold load and spark timing being retarded by more than a threshold amount, the method further comprising adjusting one or more of engine fueling and variable cam timing (VCT) based on the learned transport delay.

Another example method for an engine comprises: pulsing an intake manifold water injector to deliver an amount of water into a group of cylinders, a timing of the pulsing synchronized to an intake valve opening timing of each cylinder of the group of cylinders, the amount and the timing adjusted based on output from each of an intake manifold oxygen sensor and a knock sensor. In the preceding example, additionally or optionally, the pulsing is responsive to an indication of cylinder-to-cylinder imbalance, the indication based on the knock sensor. In any or all of the preceding examples, additionally or optionally, the pulsing includes initially pulsing the intake manifold water injector to deliver a first amount of water at a first timing synchronized with the intake valve opening timing of each cylinder of the group of cylinders; learning a cylinder-to-cylinder imbalance based on the output from the knock sensor following the initially pulsing; subsequently pulsing the intake manifold water injector to deliver a second amount of water at a second timing based on the learned cylinder-to-cylinder imbalance; learning a transport delay for each pulse of the subsequently pulsing based on the output of the oxygen sensor following the subsequently pulsing; and finally pulsing the intake manifold water injector to deliver a third amount of water at a third timing based on the learned transport delay to reduce the learned cylinder-to-cylinder imbalance. In any or all of the preceding examples, additionally or optionally, the amount and the timing adjusted based on the output from the intake manifold oxygen sensor includes adjusting the amount and timing from an initial amount and an initial timing to a final amount and final timing based on a deviation of an expected engine dilution from an actual engine dilution, the actual engine dilution based on the output of the oxygen sensor, the expected dilution based on the initial amount and further based on the an initial timing relative to the intake valve opening timing.

Another example method for an engine comprises: injecting water into an engine intake manifold; learning a cylinder-to-cylinder water injection imbalance based on individual cylinder knock intensities following the injecting; and compensating for the learned imbalance via an intake oxygen sensor. In the preceding example, additionally or optionally, the injecting includes injecting a first amount of water as multiple pulses phased as a function of engine mapping of individual cylinders. In any or all of the preceding examples, additionally or optionally, the compensating via the intake oxygen sensor includes compensating based on a deviation between an expected engine dilution following the injecting and an actual engine dilution estimated via the intake oxygen sensor. In any or all of the preceding examples, additionally or optionally, the deviation includes a first deviation between an amount of the expected engine dilution and an amount of the expected engine dilution, and a second deviation between a timing of the expected engine dilution relative to an intake valve opening timing of the individual cylinders and a timing of the expected engine dilution relative to the intake valve opening timing of the individual cylinders. In any or all of the preceding examples, additionally or optionally, the compensating further includes injecting a second amount of water as multiple pulses phased as a function of the first amount and the deviation. In any or all of the preceding examples, additionally or optionally, the method further comprises, adjusting engine fueling based on the learned imbalance.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for an engine, comprising:

injecting water into an engine intake manifold as a plurality of pulses from a water injector, the pulsing adjusted with reference to intake valve timing based on output from an intake manifold oxygen sensor.

2. The method of claim 1, wherein the injecting includes pulsing the water injector disposed in the engine intake manifold, upstream of the intake manifold oxygen sensor, to deliver an amount of water over the plurality of pulses.

3. The method of claim 1, wherein the injecting includes injecting a first amount of water as a first pulse, an initial timing of the first pulse overlapping with intake valve opening of a first cylinder, and injecting a second amount of water as a second pulse, an initial timing of the second pulse overlapping with intake valve opening of a second cylinder.

4. The method of claim 3, wherein the first amount and the second amount are based on an engine mapping of the first and the second cylinder, the engine mapping including a location of the first cylinder relative to the second cylinder along an engine block, a firing order of the first cylinder relative to the second cylinder, and a knock history of the first cylinder relative to the second cylinder.

5. The method of claim 4, wherein each of the first amount and the initial timing of the first pulse is further based on output of a knock sensor coupled to the first cylinder, following the injecting, and wherein each of the second amount and the initial timing of the second pulse is further based on output of a knock sensor coupled to the second cylinder, following the injecting.

6. The method of claim 3, further comprising learning a transport delay for each of the plurality of pulses based on the output from the intake manifold oxygen sensor.

7. The method of claim 6, wherein the learning includes learning a first transport delay for the first pulse to the first cylinder based on the output of the intake manifold oxygen sensor at an intake valve opening of the first cylinder, and learning a second transport delay for the second pulse to the second cylinder based on the output of the intake manifold oxygen sensor at an intake valve opening of the second cylinder.

8. The method of claim 7, further comprising, during a subsequent water injection, adjusting each of the first amount and the initial timing of the first pulse based on the first transport delay, and adjusting each of the second amount and the initial timing of the second pulse based on the second transport delay.

9. The method of claim 8, further comprising, during the subsequent water injection, adjusting each of the first amount and the initial timing of the first pulse based on the second transport delay, and adjusting each of the second amount and the initial timing of the second pulse based on the first transport delay.

10. The method of claim 6, wherein the pulsing is responsive to engine load being higher than a threshold load and spark timing being retarded by more than a threshold amount, the method further comprising adjusting one or more of engine fueling and variable cam timing (VCT) based on the learned transport delay.

11. A method for an engine, comprising:

pulsing an intake manifold water injector to deliver an amount of water into a group of cylinders, a timing of the pulsing synchronized to an intake valve opening timing of each cylinder of the group of cylinders, the amount and the timing adjusted based on output from each of an intake manifold oxygen sensor and a knock sensor.

12. The method of claim 11, wherein the pulsing is responsive to an indication of cylinder-to-cylinder imbalance, the indication based on the knock sensor.

13. The method of claim 11, wherein the pulsing includes:

initially pulsing the intake manifold water injector to deliver a first amount of water at a first timing synchronized with the intake valve opening timing of each cylinder of the group of cylinders;

learning a cylinder-to-cylinder imbalance based on the output from the knock sensor following the initial pulsing;

subsequently pulsing the intake manifold water injector to deliver a second amount of water at a second timing based on the learned cylinder-to-cylinder imbalance;

learning a transport delay for each pulse of the subsequent pulsing based on the output of the oxygen sensor following the subsequent pulsing; and finally pulsing the intake manifold water injector to deliver a third amount of water at a third timing based on the learned transport delay to reduce the learned cylinder-to-cylinder imbalance.

14. The method of claim 11, wherein the amount and the timing adjusted based on the output from the intake manifold oxygen sensor includes adjusting the amount and the timing from an initial amount and an initial timing to a final amount and a final timing based on a deviation of an expected engine dilution from an actual engine dilution, the actual engine dilution based on the output of the oxygen sensor, the expected engine dilution based on the initial amount and further based on the initial timing relative to the intake valve opening timing.

15. A method for an engine, comprising:

injecting water into an engine intake manifold;

learning a cylinder-to-cylinder water injection imbalance based on individual cylinder knock intensities following the injecting; and compensating for the learned imbalance via an intake oxygen sensor.

16. The method of claim 15, wherein the injecting includes injecting a first amount of water as multiple pulses phased as a function of engine mapping of individual cylinders.

17. The method of claim 16, wherein the compensating via the intake oxygen sensor includes compensating based on a deviation between an expected engine dilution following the injecting and an actual engine dilution estimated via the intake oxygen sensor.

18. The method of claim 16, wherein the deviation includes a first deviation between an amount of the expected engine dilution and an amount of the actual engine dilution, and a second deviation between a timing of the expected engine dilution relative to an intake valve opening timing of the individual cylinders and a timing of the actual engine dilution relative to the intake valve opening timing of the individual cylinders.

19. The method of claim 17, wherein the compensating further includes:

injecting a second amount of water as multiple pulses phased as a function of the first amount and the deviation.

20. The method of claim 15, further comprising, adjusting engine fueling based on the learned imbalance.

* * * * *